US007160151B1

(12) United States Patent
Rigby et al.

(10) Patent No.: US 7,160,151 B1
(45) Date of Patent: Jan. 9, 2007

(54) ELECTRICAL CONNECTOR SYSTEM

(75) Inventors: William J. Rigby, Somis, CA (US); Scott S. Blaise, Camarillo, CA (US)

(73) Assignee: Component Equipment Company, Inc., Oxnard, CA (US)

( * ) Notice: Subject to any disclaimer, the term of this patent is extended or adjusted under 35 U.S.C. 154(b) by 0 days.

(21) Appl. No.: 11/300,707

(22) Filed: Dec. 14, 2005

(51) Int. Cl.
*H01R 13/648* (2006.01)

(52) U.S. Cl. ..... 439/607; 439/608

(58) Field of Classification Search ..... 439/78, 439/83, 607, 608
See application file for complete search history.

(56) References Cited

U.S. PATENT DOCUMENTS 5,415,566 A * 5/1995 Brunker et al. ..... 439/608
5,718,606 A 2/1998 Rigby et al.
6,361,366 B1 * 3/2002 Shuey et al. ..... 439/608
6,491,529 B1 * 12/2002 Gray et al. ..... 439/79
6,848,917 B1 * 2/2005 Lang et al. ..... 439/79
6,916,188 B1 * 7/2005 Lang et al. ..... 439/101
6,918,789 B1 * 7/2005 Lang et al. ..... 439/608

* cited by examiner

*Primary Examiner*—Khiem Nguyen
(74) *Attorney, Agent, or Firm*—Jack C. Munro; Sandy Lipkin

(57) ABSTRACT

The subject invention is an electrical connector system for a pair of printed circuit boards which utilizes a vertical female connector which is to be connected to one printed circuit board and a separate right angled male connector which has a housing which includes a plurality of right angled first electrically positive terminals which are to be used to connect to a second printed circuit board. Both printed circuit boards are connected together in a right angle relationship with one printed circuit board being located edgewise to the other printed circuit board. A mass of separate positive circuit paths is obtained by the terminals from one printed circuit board to the other. The vertical female connector and the right angled male electrical connector are fixedly mounted on their respective printed circuit boards.

3 Claims, 4 Drawing Sheets

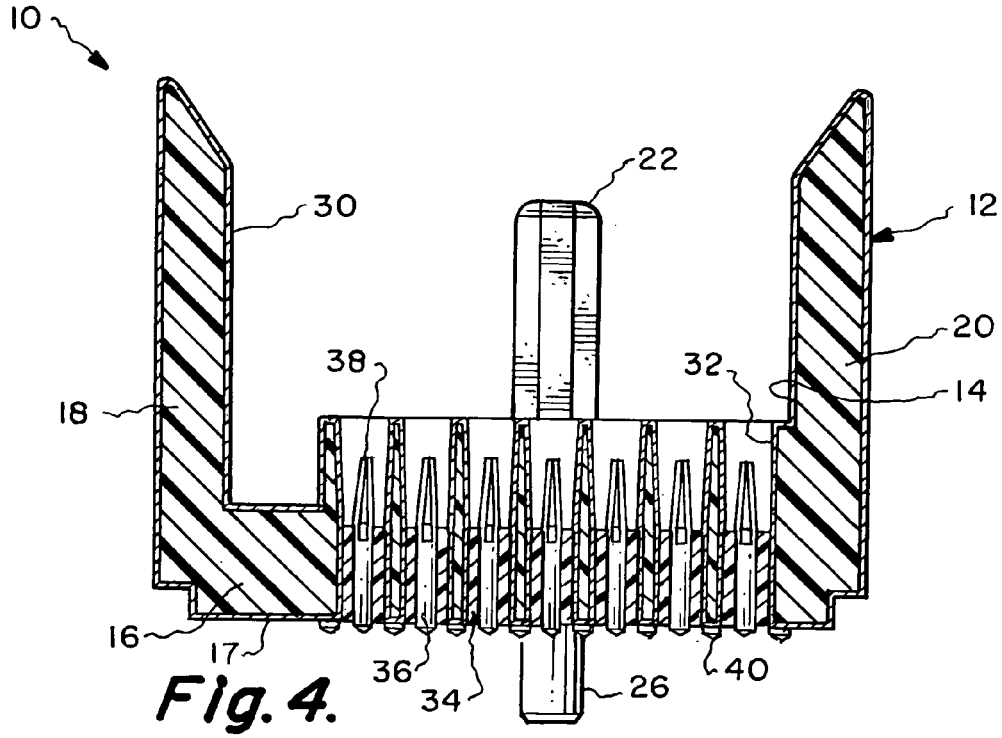
Fig. 4.
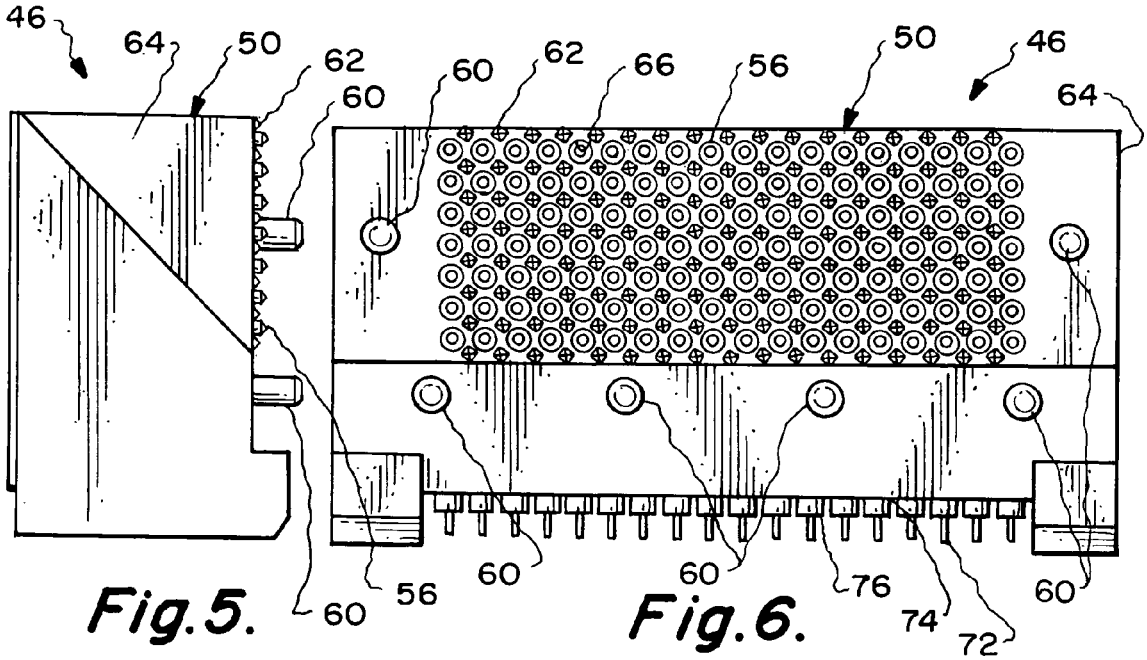
Fig. 5.
Fig. 6.

ELECTRICAL CONNECTOR SYSTEM

BACKGROUND OF THE INVENTION

1. Field of the Invention

This invention is related to an electrical connector and particularly to an electroplated monolithic electroplated plastic electrical connector body that establishes a mass of negative ground points surrounding a polarity of one or more positive signal carrying insulated conductors, connected via a male conductor connecting to a female conductor which then connects two circuits together, to be terminated to a circuit carrying board or cable via surface soldering or conductive gluing. The conductive plastic body forms a continuous ground shield around each positive insulated carrying conductor from one circuit board or cable to another circuit board or cable with a minimal loss of electrical performance.

2. Description of the Related Art

The subject matter of the present invention is basically an improvement over what was previously disclosed and claimed in U.S. Pat. No. 5,718,606 that has been obtained by the inventors of the present invention.

Electrical connectors are commonly used in telecommunication and computer applications. Electrical connectors are commonly mounted on printed circuit boards, or used in connecting a pair of cables.

A printed circuit board is a sheet like material having circuits or paths leading to the connector and component termination. The connectors typically have one or more circuit paths connected to the components such as controller and central processing memory chipsets. It is common to have to connect a plurality of printed circuit boards or cables together via connectors.

It is typical that an electrical connector between a pair of circuit boards or cables will include a substantial number of separate circuit paths. In the past, prior art connectors have been known to include any number of circuit paths within a single connector.

Typically within the prior art, it has been common to connect the printed circuits together using a pin and socket surrounded by a plastic insulated body. This insulated body would use a polarity of ground pins or shields surrounding the signal carrying conductor pin to reduce cross talk between adjacent signal carrying conductor pins. The current invention reduces the number of ground pins needed by replacing the surrounding ground pins or shields of the signal carrying conductor by a monolithic electrically conductive body with integral connecting ground points surrounding the signal carrying conductor, eliminating the need for using valuable printed circuit board space which is common within previous connectors.

SUMMARY OF THE INVENTION

The basic embodiment of an electrical connector system of the present invention includes a right angled male connector which has an electrically conducting housing having a first face and a second face. The first face is oriented at ninety degrees relative to the second face. A plurality of electrical first positive terminals are mounted within the housing at a spaced apart arrangement. Each of these terminals terminate in a first end and a second end. The first end protrudes only slightly from the first face establishing a surface mount solderable connection with each first end protruding the same distance from the first face. The second end of the terminals extends outward a substantial distance from the second face. A plurality of electrical ground points are located on the first face directly adjacent but spaced from each terminal with there being a series of these ground points surrounding each terminal. These points are commonly electrically grounded by an electrical conductive layer covering the housing. Each ground point protrudes from the first face the same distance.

The first electrically positive terminals can be evenly spaced apart and can extend the same distance from the first face as the electrical ground points. Each first electrically positive terminal is electrically insulated relative to the housing by a combination of air and dielectric insulation.

A further embodiment of the present invention is where the basic embodiment is modified by defining that there is a vertical female connector which has a body which has a cavity. A mass of evenly spaced apart holes are formed within the body which connect with the cavity. The cone structure interlocks with the holes where each cone structure forms an encircling enclosure about its respective first electrical positive terminal. The interlocking of the cone structures with the holes completes the ground shield from the right angled male connector with the vertical female connector.

A further embodiment of the present invention is where the just previous embodiment is modified by defining that the vertical female connector has an interface termination surface formed on said body which is electrically conductive. The interface termination surface includes a mass of ground termination points and at least one second electrical positive terminal which is electrically insulated from the electrically conductive body.

BRIEF DESCRIPTION OF THE DRAWINGS

For a better understanding of the present invention, reference is to be made to the accompanying drawings. It is to be understood that the present invention is not limited to the precise arrangement shown in the drawings.

FIG. 4 is a transverse cross-sectional view through the vertical female connector of the present invention taken along line 4—4 of FIG. 1;

FIG. 5 is a side elevational view of the right angled male connector of the present invention;

FIG. 6 is a right side view of the right angled male connector of FIG. 5;

DETAILED DESCRIPTION OF THE INVENTION

Figure 1:
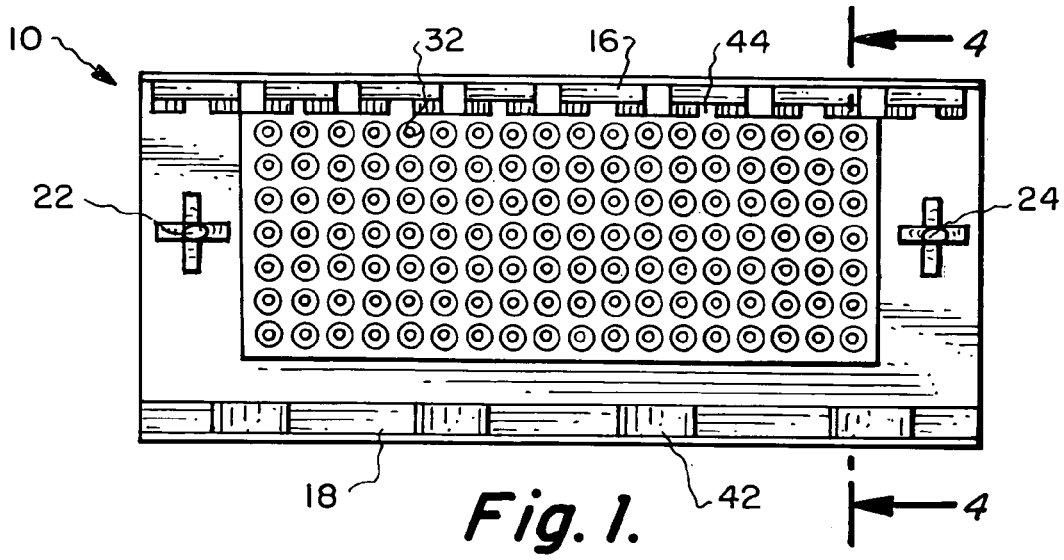
FIG. 1 is a top plan view of the vertical female connector that is utilized in the electrical connector system of the present invention and is deemed to be part of the surface mount electrical connector of this invention.
Figure 2:
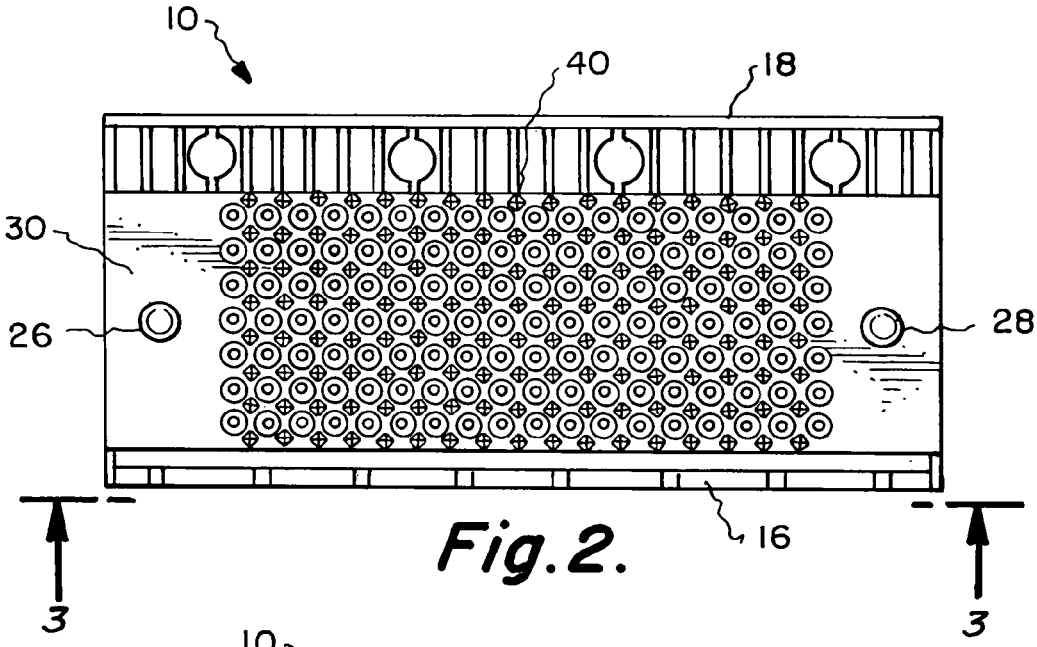
FIG. 2 is a bottom plan view of the vertical female connector of the present invention.
Figure 3:
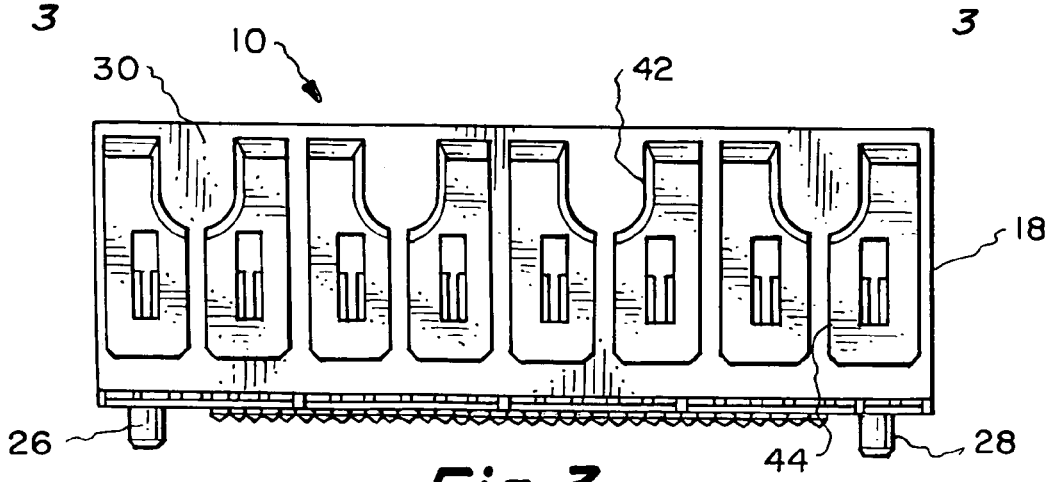
FIG. 3 is a cross-sectional view through the vertical female connector of the present invention taken along line 3—3 of FIG. 2.
Figure 7:
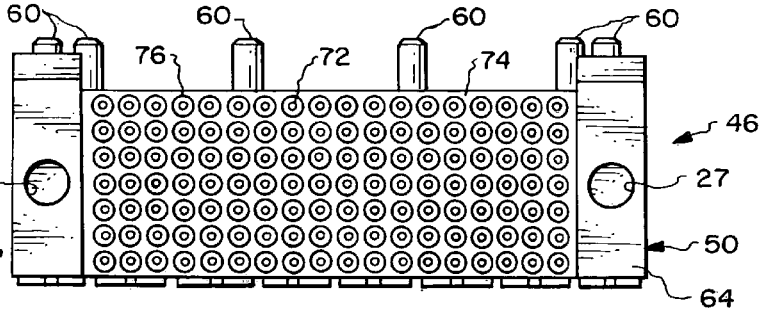
FIG. 7 is a bottom plan view of the right angled male connector of FIG. 5.
Figure 8:
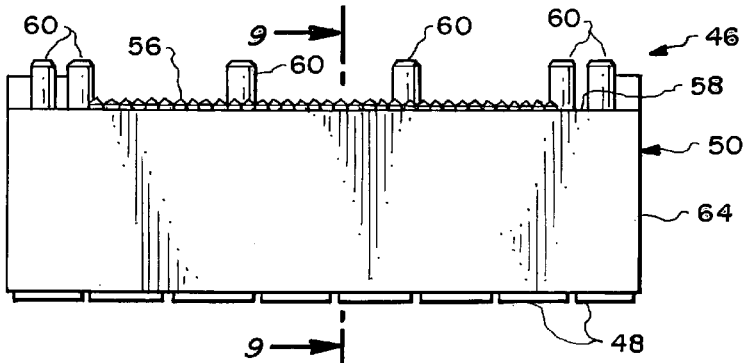
FIG. 8 is a top plan view of the right angled male connector of FIG. 5.
Figure 9:
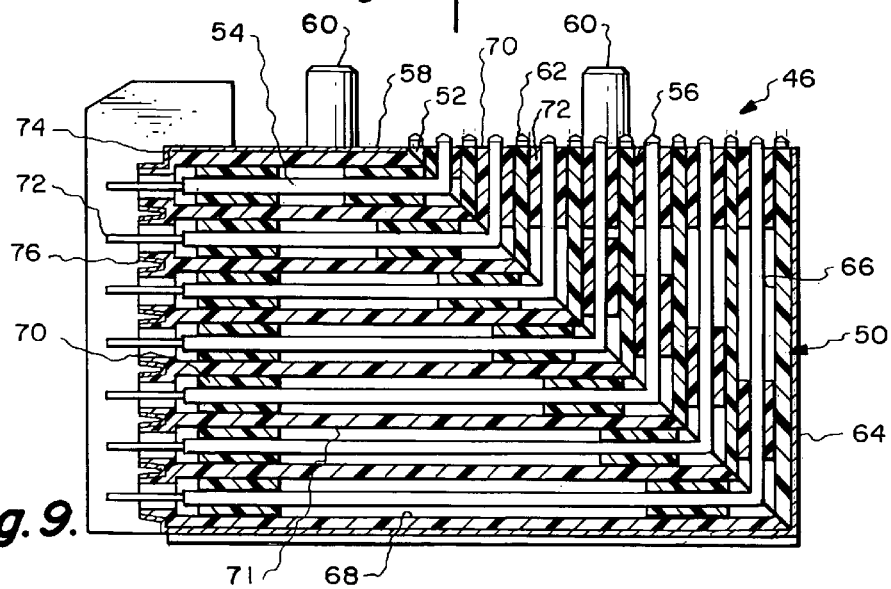
FIG. 9 is a transverse cross-sectional view through the right angled male connector taken along line 9—9 of FIG. 8.
Figure 10:
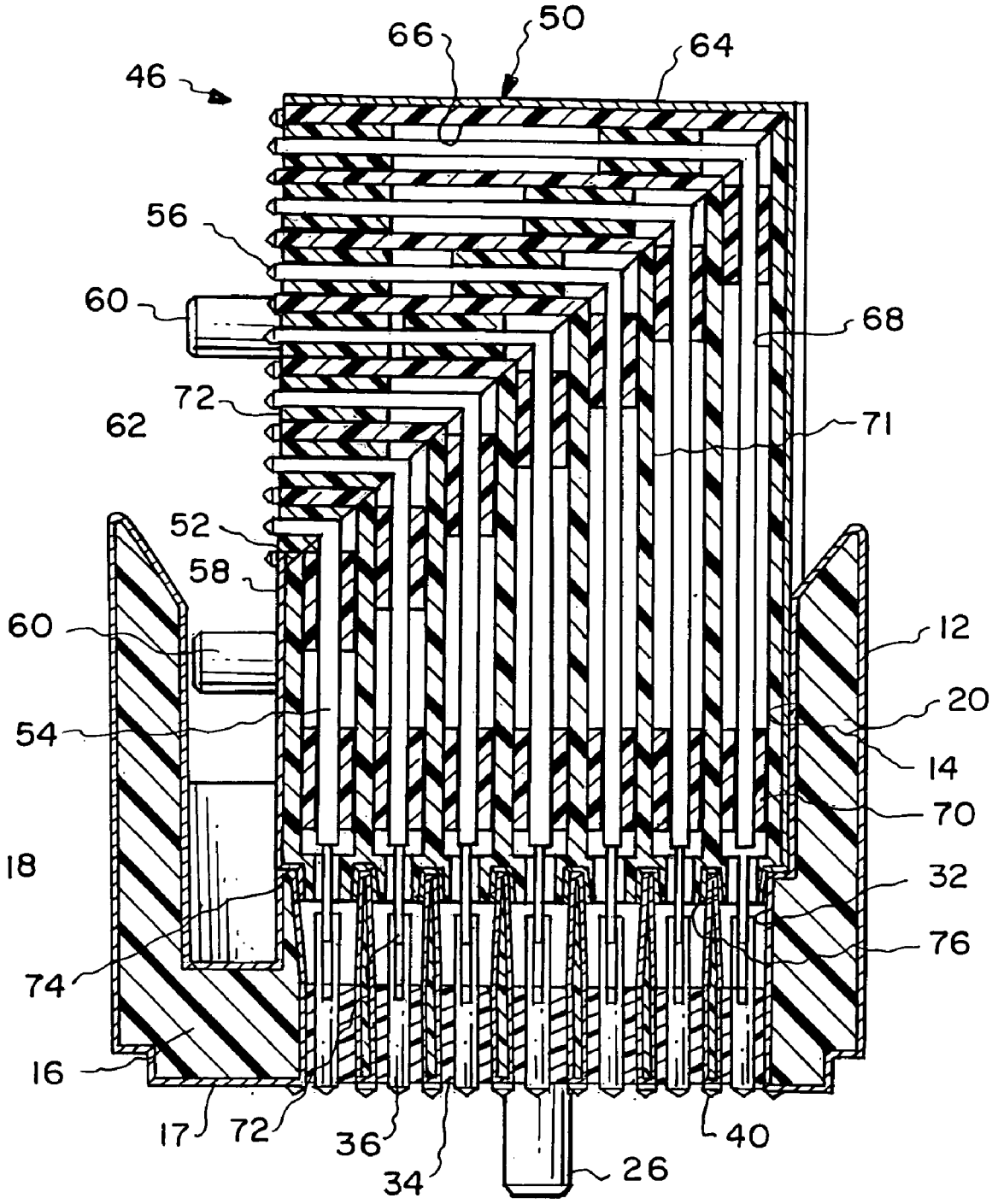
FIG. 10 is a transverse cross-sectional view through the assembled interconnect electrical connector system which is composed of a right angled male connector and a vertical female connector.

Referring particularly to FIGS. 1–4 of the drawings, there is shown the vertical female connector 10 which is considered to be part of the connector system 11 of the present invention, shown in FIG. 10. The vertical female connector 10 is constructed of an electrically insulative housing 12 which is formed in transverse cross-section in a U-shape defining an open ended internal cavity 14. The open ended internal cavity 14 is formed by a base 16 from which extends to one side thereof to a wall 18 and from the other side thereof to a wall 20. Typical material of construction for the housing 12 would be a plastic. Mounted on the base 16 and located within the cavity 14 are a pair of spaced apart mounting pins 22 and 24. It is noted that the mounting pins 22 and 24 are not round but actually include a rib on each side of the pins 22 and 24 with there being four in number of the ribs. Mounted on the bottom of the housing 12 are a pair of spaced apart alignment pins 26 and 28. The function of the pins 22, 24, 26 and 28 will be explained further on in the specification.

The entire exterior surface of the housing 12 is to be covered with an electrically conductive layer 30. Typical material for the electrically conductive layer 30 would be a copper or a copper/nickel composition. Also, gold can be used. Although the housing 12 is described as being completely covered with the electrically conductive layer 30, such is done solely for the reason of economy as it is less costly to completely cover the housing 12 rather than partially cover such. It is considered to be within the scope of this invention that the housing 12 could be coated with an electrically conductive layer 30 in selective areas rather than complete coating of the exterior surface of the housing 12.

Through the base 16 are a plurality of through holes 32. It is to be noted there are one-hundred twenty-six of the through holes 32 although this number could be increased or decreased. Mounted within each through hole 32 is an insulative sleeve 34. Mounted within each insulative sleeve 34 is a pin connector 36. The inner end of each pin connector 36 is defined by a pair of members 38 which are naturally biased toward each other and will actually contact each other, as shown in FIG. 4. The members 38 can be spread apart, as will be explained further on in the specification. The exterior surface of the base 16 has an interface termination surface 17 that includes a mass of ground termination points 40. There is at least one ground termination point 40 for each through hole 32, and actually there are few more ground termination points 40 than through holes 32. Each ground termination point 40 extends the same short distance off the exterior surface of the base 16. Each ground termination point 40 has a pointed configuration. The outer end of each pin connector 36 also has a pointed configuration. It is to be noted that the outer ends of the pin connectors 36 also protrude slightly off the surface of the base 16, as is clearly shown in FIG. 4, with this protrusion being the same as the protrusion of the ground termination points 40.

Vertical female connector 10 is to be installed in conjunction with a printed circuit board, which is not shown. That printed circuit board is to include a mass of pads (not shown) and surrounding each pad is a grounding connector. The alignment pins 26 are to be used to properly align the vertical female connector 10 when it is installed in conjunction with the printed circuit board with each mounting alignment pin 26 being located within an appropriate alignment hole of that printed circuit board. When the vertical female connector is then tightly located against the printed circuit board, each pin connector 36 will be located tightly against a pad thereby forming a positive electrical connection therebetween which is assisted by the sharp pointing of the pin connectors 36. Each ground termination point 40 will also come into contact with the grounding layer of the printed circuit board thereby forming a satisfactory electrical ground connection (ground shield) between the connector 10 and the printed circuit board. The inner surfaces of the walls 18 and 20 are to include appropriate guide slots 42 and 44 within their respective walls 18 and 20 that insure that the right angled male connector 46 of this invention will be precisely installed in its proper position in conjunction with the cavity 14 (see FIG. 10). There are appropriate ridges and cavities 48 formed within the sidewall of the housing 50 that interlockingly engage with the guide slots 42 and 44 so as to insure that the right angled male 46 is properly and correctly installed in conjunction with the vertical female connector 10.

The housing 50 is actually constructed of two different parts which are joined together on a diagonal 52. It is to be understood that the basic material of construction for the housing 50 will be an electrically insulative plastic. Mounted within the housing 50 are a plurality of L-shaped elongated positive terminals 54. Each terminal 54 terminates in a first end 56 which is sharp pointed and protrudes slightly from a first face 58 of the housing 50. This establishes a surface mount solderable connection. Also mounted on the first face 58 are a plurality of alignment pins 60. The actual number of alignment pins 60 is shown to be six although this number could be increased or decreased as desired. There are to be one-hundred twenty-six in number (+ or −) of the positive terminals 54. Mounted on the first face 58 are a plurality of ground points 62. There will be something in the range of one-hundred twenty-six to one-hundred thirty-six ground points 62 (+ or −), and each ground point 62 protrudes a short distance from the first face 58. It is to be noted that the protruding of the ground points 62 is equal to the distance of the protrusion of the first ends 56 which all protrude the same distance from the first face 58. The entire exterior surface including the ground points 62 are coated with an electrically conductive layer 64.

Each positive terminal 54 is mounted within a through hole 66 formed within the upper portion of the housing 50, and then with the remaining portion of the terminals 54, which is located at a right angle to the first mentioned portion, is mounted within a through hole 68 formed within the housing 50. Surrounding each positive terminal 54 and located within each of the through holes 66 and 68 are electrically insulative sleeves 70. The sleeves 70 function to properly centrally position the positive terminals 54 within the through holes 66 and 68 to where the positive terminal 54 will not contact the sidewall of the through hole 66 and 68 but will be maintained in a spaced relationship relative thereto. If the positive terminal 54 does contact the sidewall, a short electrical connection will be established and the electrical surface mounting connector 46 will not operate correctly. It is to be noted that the sleeves 70 are not continuous but include air gaps 71. This air in combination with the dielectric sleeves 70 has been found to provide the best electrical insulation rot eh terminals 56 relative to the housing 50.

The second end 72 comprises a protruding pin that protrudes from the second face 74 of the housing 50. Surrounding each second end 72 is a socket 76. It is to be noted that each socket 76 protrudes from the second face 74. The sockets 76 extend outwardly from second face 74. It is to be noted that each of the second ends 72 extend the same amount from the second face 74 but this is not necessary in some embodiments the extension of the second ends may vary in length.

Each of the sockets 76 is coated with an electrically conductive layer. Each socket is tapered assuring a cone shape. A single socket 76 is to be snugly mounted within a through hole 32 of the vertical female connector 10 with the tapering of the wall of the sockets producing a tight connection. This establishes an electrically grounding connection between the connector 10 and the connector 46.

At the same time, a second end 72 is to be mounted within a single member 38 with the member 38 becoming spread apart so as to form a secure positive electrical connection therebetween. The first ends 56 of the positive terminals 54 are to be tightly inserted into pads of a printed circuit board, which is not shown. The ground points 62 will form an electrically grounding connection with this printed circuit board. The connector 46 is then interlockingly connected to the vertical female connector 10 which is mounted on a second printed circuit board, which has been previously described. This interlocking connection establishes a tight enclosing connection of each of the first ends 56 with a ground shield established between connector 10 and the connector 46. The ribbed pins 22 and 24 forms a tight fit within appropriate holes 25 and 27, respectively, formed in housing 50. Thus, an electrical connection is established between the one-hundred and twenty-six (+ or −) separate circuit paths between the two printed circuit boards by using of a single pair of connectors 10 and 46.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An electrical connector system comprising:

a right angled male connector having an electrically conducting housing having a first face and a second face with said first face being oriented at ninety degrees relative to said second face, a plurality of first electrically positive terminals mounted within said housing in a spaced apart arrangement, each of said first electrically positive terminals terminating in a first end and a second end, said first electrically positive terminals being evenly spaced apart, said first end of each of said first electrically positive terminals protruding only slightly from said first face establishing a surface mount solderable connection with each said first end protruding the same distance from said first face, said second end of said first electrically positive terminals extending outward a substantial distance from said second face; and a plurality of electrical ground points located on said first face directly adjacent but spaced from each said first electrically positive terminal with there being a series of said ground points surrounding each said electrically positive terminal, said points being commonly electrically grounded by an electrically conductive layer covering said housing, each said ground point protruding the same distance from said first face, said first end of said electrically positive terminals extending the same distance from said first face as said electrical ground points;

a shielded cone structure having a tapered wall surface surrounding but spaced from each said second end of said first electrically positive terminals, each said cone structure protruding from said second face, each said cone structure including said electrically conductive layer, whereby when said second ends are electrically connected to a separate connector said tapered wall surface of each said cone structure produces a tight enclosing fit with a hole formed in the separate connector producing a ground shield for each said first electrically positive terminal, each said first electrically positive terminal being electrically insulated relative to said housing by a combination of air and dielectric insulator.

2. The electrical connector system as defined in claim 1 wherein the separate connector comprises:

a vertical female connector having a body which has a cavity, a mass of spaced apart holes formed within said body with connecting said cavity, each said cone structure interlocking with a hole of said holes forming said tight enclosing fit completing said ground shield from said right angled male connector and said vertical female connector.

3. The electrical connector system as defined in claim 2 wherein:

said vertical female connector having an interface termination surface formed on an exterior surface of said body which is electrically conductive, said interface termination points and at least one second electrically positive terminal which is electrically insulated from said electrically conductive body.

* * * * *